US007600274B2

(12) United States Patent
Washington

(10) Patent No.: US 7,600,274 B2
(45) Date of Patent: Oct. 13, 2009

(54) DISPOSABLE SHOWER CURTAIN ASSEMBLY

(76) Inventor: Andria C. Washington, 1607 Columbia Ave., Atlantic City, NJ (US) 08401

( * ) Notice: Subject to any disclaimer, the term of this patent is extended or adjusted under 35 U.S.C. 154(b) by 793 days.

(21) Appl. No.: 11/339,407

(22) Filed: Jan. 26, 2006

(65) Prior Publication Data

US 2008/0016612 A1 Jan. 24, 2008

(51) Int. Cl.
*A47K 3/00* (2006.01)

(52) U.S. Cl. ..... 4/608; 4/558; 160/330; 160/350

(58) Field of Classification Search ..... 4/608, 4/558; 160/330, 350, DIG. 6
See application file for complete search history.

(56) References Cited

U.S. PATENT DOCUMENTS 4,120,343 A * 10/1978 Wilson ..... 160/330
4,126,172 A * 11/1978 Faragher, Jr. ..... 160/126
5,216,764 A 6/1993 Hall et al.
5,231,708 A * 8/1993 Hansen ..... 4/608
6,038,749 A 3/2000 Eberhardt
6,192,965 B1 2/2001 Hinds
2003/0131405 A1* 7/2003 Greaves ..... 4/558
2006/0000013 A1* 1/2006 Peoples ..... 4/558
2006/0248641 A1* 11/2006 Kinstle et al. ..... 4/608
2007/0215296 A1* 9/2007 Voutour ..... 160/330
2007/0256232 A1* 11/2007 Erickson ..... 4/558

* cited by examiner

*Primary Examiner*—Gregory L Huson
*Assistant Examiner*—Karen Younkins

(57) ABSTRACT

A disposable shower curtain assembly includes an anchor bracket that has planar front and rear faces, and has opposed ends. The anchor bracket is provided with apertures for receiving support rings therethrough and has a notch extending along a length thereof. The notch has an open bottom end that extends towards a top face of the bracket. Disposable water-impermeable shower liners have top edges nested within the notch. Each liner has a bottom-, a left side- and a right side-edge monolithically formed with the top edge, and also has a tab formed therewith that is positioned at a top corner of an associated liner. Adjacent front and back faces of the liners are continuously attached such. A mechanism is included for removably affixing the shower liners together so that a perimeter of an outer liner remains sealed to a perimeter of an adjacent liner.

18 Claims, 5 Drawing Sheets

DISPOSABLE SHOWER CURTAIN ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to shower curtains and, more particularly, to a disposable shower curtain assembly for providing a plurality of disposable shower curtains hanging from a horizontally registered support rod.

2. Prior Art

Ornamented or colorful shower curtains hanging from a rod by hooks are in some instances protected in the rear by a separate shower curtain liner to prevent the shower curtain from excessive accumulation of dirt and soap solutions on the rear surface of the shower curtain. Cleaning of the liner requires removal from the shower hooks which necessitates the reaching up and sometimes inadvertently tearing holes in the plastic liner in the process. This is a very time consuming process, especially if more than one shower curtain liner must be removed in such a fashion.

Commercial establishments like hotels and motels, and institutes like a hospital or a retirement home may find this practice too time consuming and expensive to be feasible. Thus, they are left with the options of either not cleaning the liner, which can quickly become very unsanitary, or periodically replacing the shower curtain liners with new ones. The latter practice, however, can also become rather expensive over extended periods of time.

Accordingly, a need remains for a disposable shower curtain assembly in order to overcome the above-noted shortcomings. The present invention satisfies such a need by providing a shower curtain assembly that is easy and convenient to use, is disposable in nature, is attractive and practical in design, and is effective for widespread use. Such a shower curtain assembly improves the sanitary conditions in any residential or commercial bathroom. With the disposable liner, a person does not have to contact germs and bacteria that accumulate on standard shower curtain liners. The assembly also eliminates the hassle and time-consuming process of cleaning conventional shower curtain liners. Such an assembly furthermore, eliminates the hassle of removing a standard liner from the shower curtain hooks each time it is replaced or cleaned, which saves a busy individual a considerable amount of time and effort.

BRIEF SUMMARY OF THE INVENTION

In view of the foregoing background, it is therefore an object of the present invention to provide a disposable shower curtain assembly. These and other objects, features, and advantages of the invention are provided by a disposable shower curtain assembly for providing a plurality of disposable shower curtains hanging from a horizontally registered support rod.

The disposable shower curtain assembly includes an anchor bracket that has a planar front face facing an interior of a shower and further has a planar rear face facing oppositely away from the shower. Such an anchor bracket is preferably formed from rigid and non-corrosive material. The anchor bracket is further formed from disposable material such that the user can advantageously and conveniently discard the anchor bracket after a final one of the shower liners is detached therefrom.

Such an anchor bracket further has a rectilinear and elongated shape provided with axially opposed ends positioned at opposite ends of a shower wall. The anchor bracket is provided with a plurality of apertures formed therein that are equidistantly spaced along a longitudinal length of the anchor bracket. Each of the apertures traverses a longitudinal axis of the anchor bracket and is suitably sized for effectively receiving a support ring therethrough. The anchor bracket further has a notch medially formed therein that extends along the entire longitudinal length of the anchor bracket. Such a notch has an open bottom end that extends upwardly towards a top face of the anchor bracket wherein the notch terminates subjacent the apertures and has a U-shaped cross-section.

A plurality of disposable shower liners have top edges intercalated and nested within the notch in such a manner that the shower liners are effectively supported by the anchor bracket respectively. Such shower liners are formed from a disposable and water-impermeable material. Each of the shower liners further has a bottom edge, a left side edge and a right side edge monolithically formed with the top edge respectively. Such a bottom edge of the outer shower liner may be partially detached from the bottom edge of the adjacent shower liner during showering conditions such that the top edges of the outer and adjacent shower liners remain directly affixed during showering conditions. Each shower liner also has a tab monolithically formed therewith. Each of the tabs is positioned at a top corner of an associated one of the shower liners wherein the top corner is defined at a juncture of the top edge and the left side edge of each shower liner. Adjacent front and back faces of the shower liners are directly and continuously attached such that the shower liners remain coplanar during non-showering conditions.

A mechanism is included for removably affixing the shower liners together in such a manner that an entire perimeter of an outer one of the shower liners remains sealed directly to an entire perimeter of an adjacent one of the shower liners during showering conditions. Such an adjacent shower liner is effectively and advantageously hidden by the outer shower liner during showering conditions. The outer shower liner is completely and effectively detachable from the anchor bracket and the adjacent shower liner when a user pulls an associated one of the tabs downwardly and away from the anchor bracket. The adjacent shower liner becomes exposed after the outer shower liner is detached from the anchor bracket such that the adjacent shower liner directly faces the interior of the shower.

The removably affixing mechanism preferably includes a unitary and continuous adhesive layer that includes a water-insoluble sealant running along a perimeter of a rear face of each of the shower liners. Such an adhesive layer is directly connected to the rear face of each of the shower liners such that the adhesive layer is effectively and advantageously isolated from water during showering procedures. The adhesive layer may be positioned along the top edge, the bottom edge, the left side edge and the right side edge of each of the shower liners respectively. Such top edges of the shower liners are preferably sandwiched between the front and rear faces of the anchor bracket such that a portion of the adhesive layer is interfitted within and along the notch during anchored conditions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
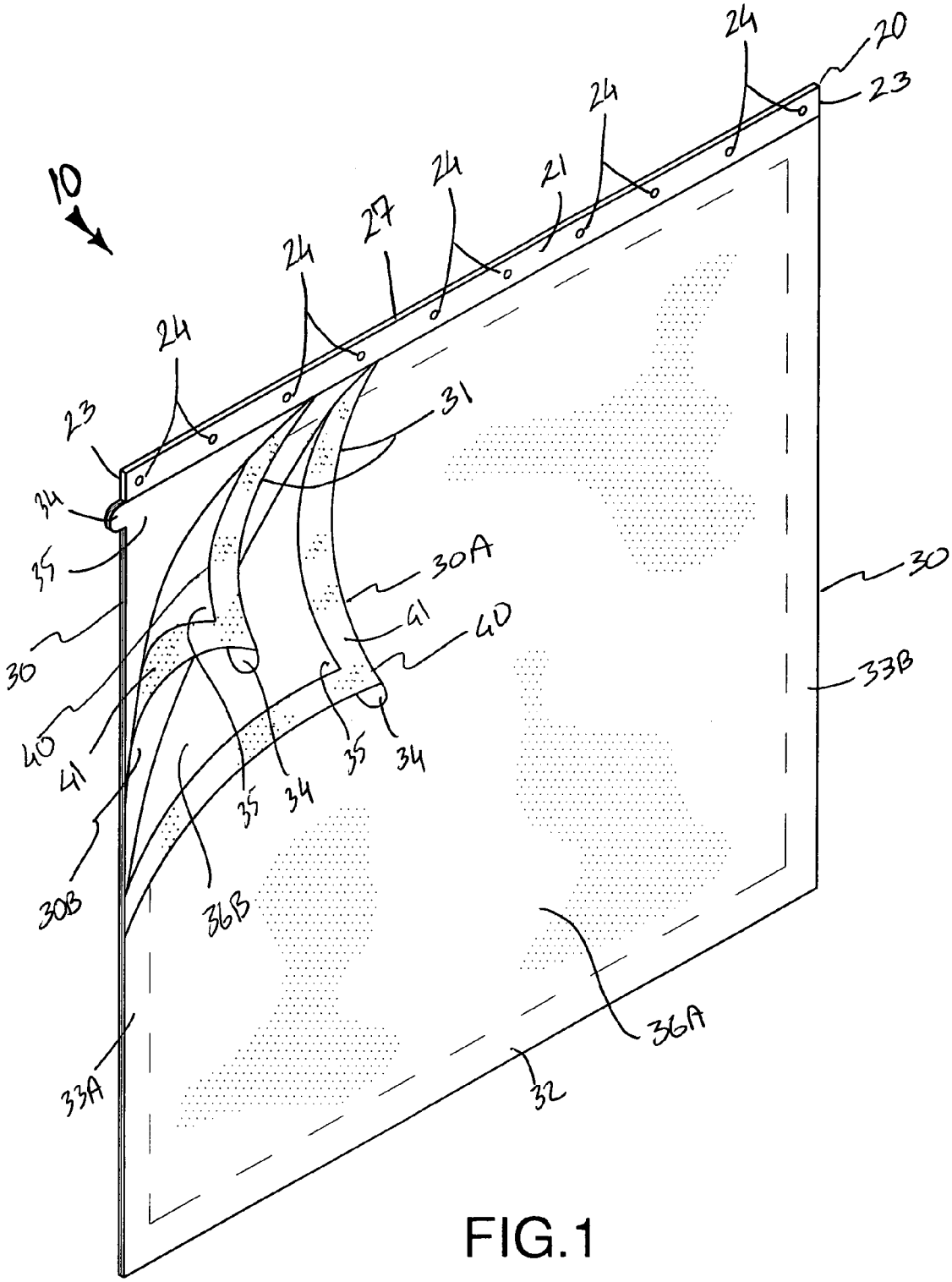
FIG. 1 is a perspective view showing a disposable shower curtain assembly, in accordance with the present invention.
Figure 2:
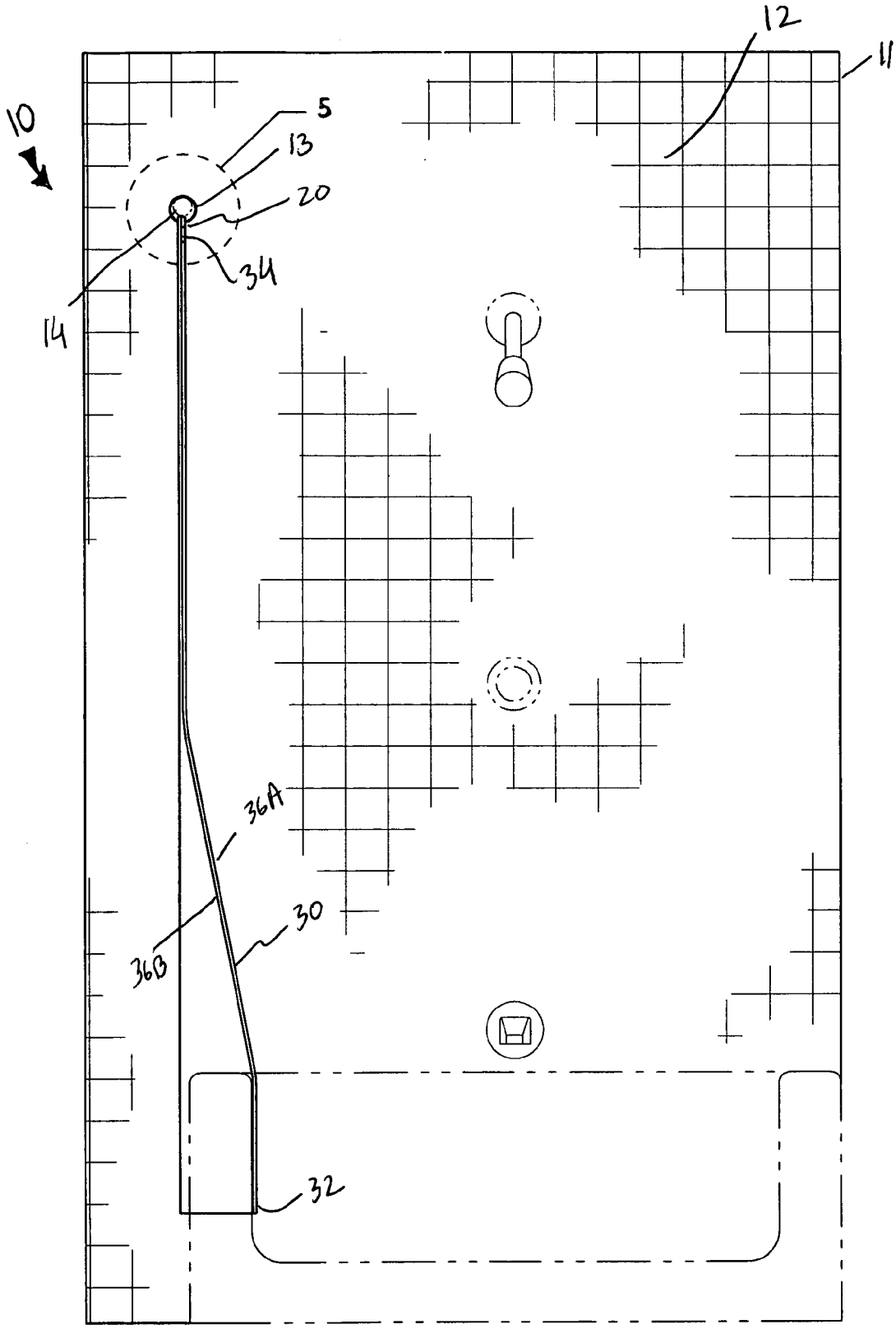
FIG. 2 is a side-elevational view of the assembly shown in FIG. 1, showing the assembly suspended from shower hooks.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-5 by the reference numeral 10 and is intended to provide a disposable shower curtain assembly. It should be understood that the assembly 10 may be used to line many different types of shower curtains and should not be limited in use to only one specific style of shower curtain.

Referring initially to FIGS. 1, 3, 4 and 5, the assembly 10 includes an anchor bracket 20 that has a planar front face 21 facing an interior of a shower 11 and further has a planar rear face 22 facing oppositely away from the shower 11. Such an anchor bracket 20 is formed from rigid and non-corrosive material, which is important for preventing the anchor bracket 20 from being adversely affected by the moist conditions in which same is employed. The anchor bracket 20 is further formed from disposable material, which is an essential feature such that the user can advantageously and conveniently discard the anchor bracket 20 after a final one of the shower liners 30 (described herein below) is detached therefrom.

Figure 3:
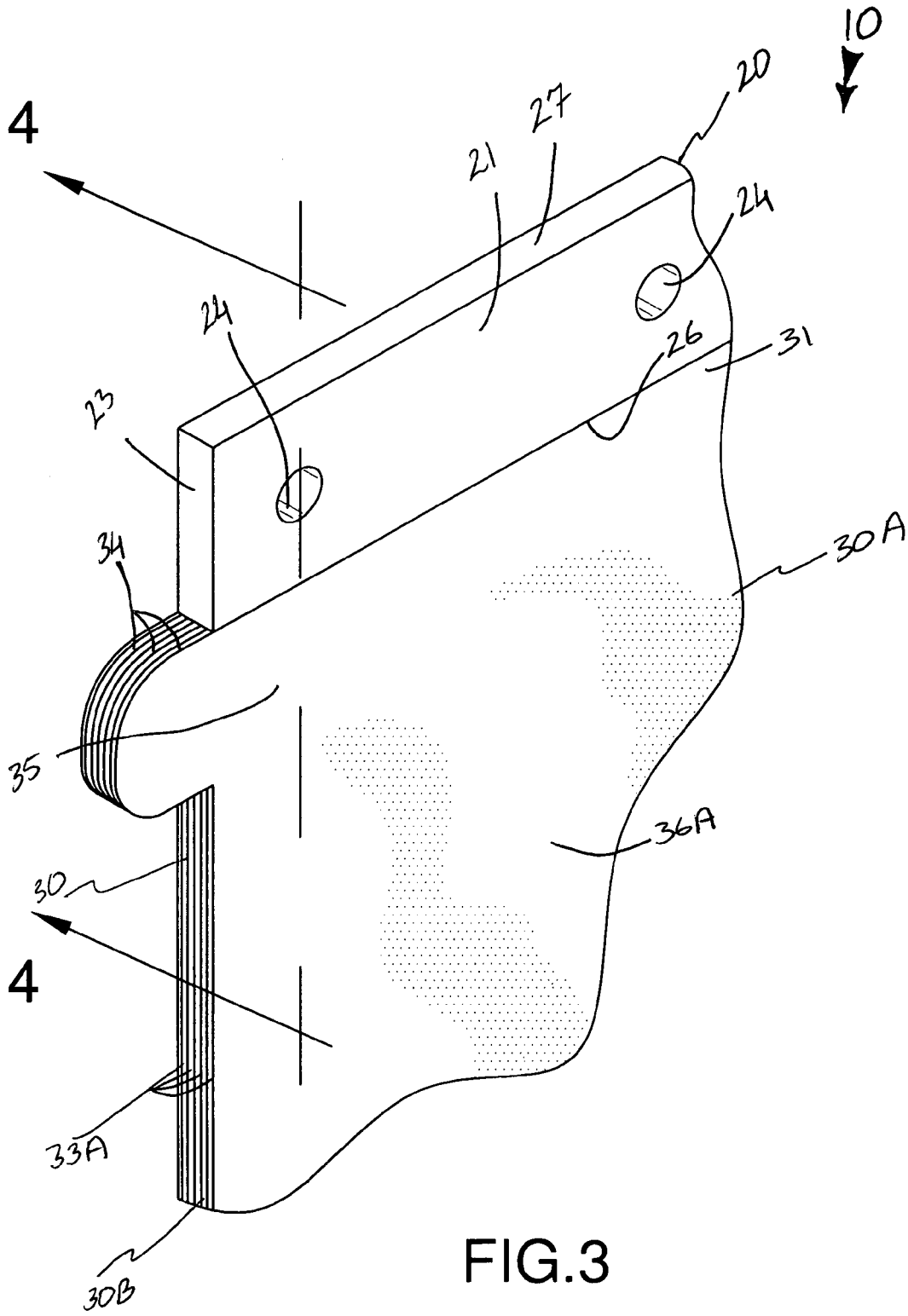
FIG. 3 is an enlarged perspective view of the assembly shown in FIG. 1, showing the removable nature of the shower liners.
Figure 4:
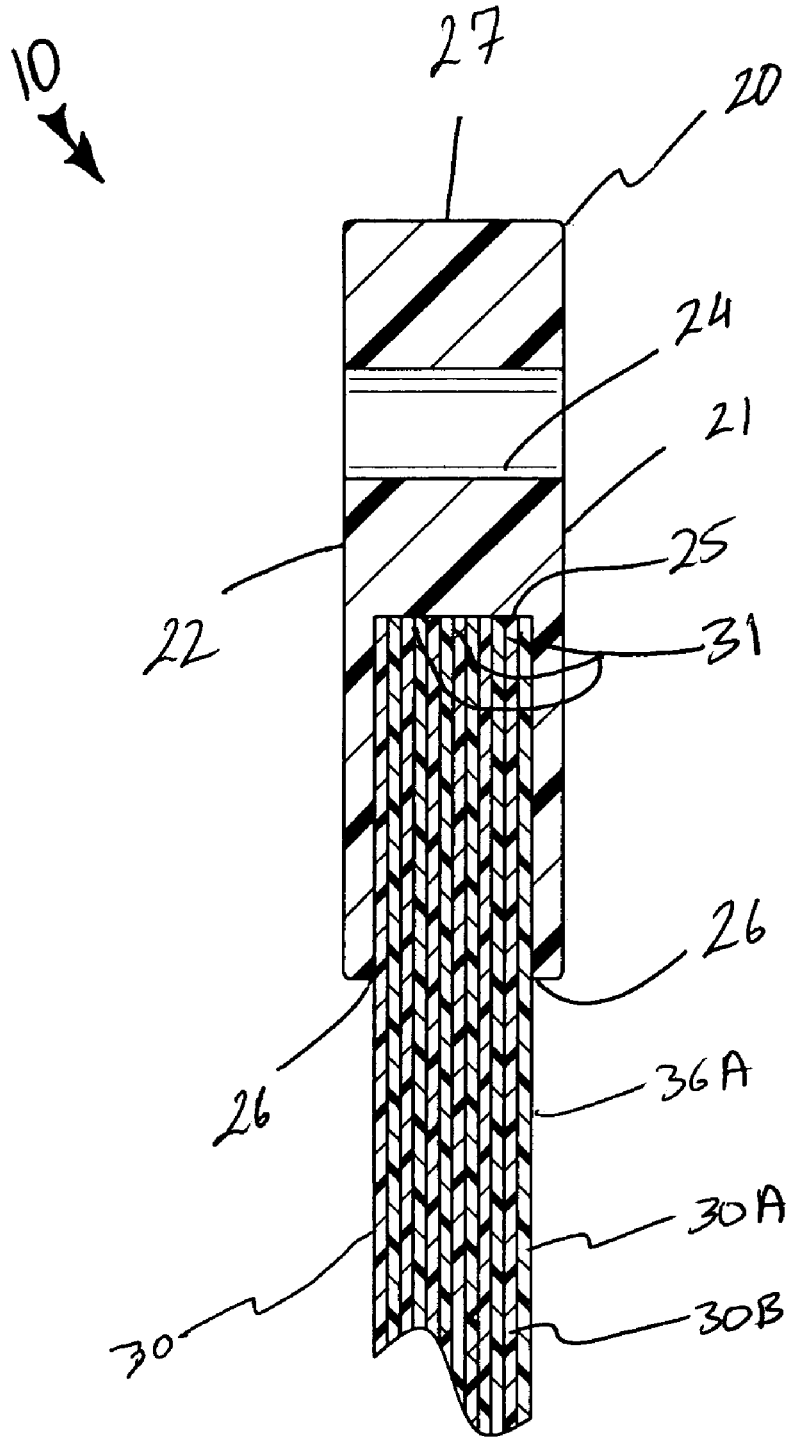
FIG. 4 is a cross-sectional view of the assembly shown in FIG. 3, taken along line 4-4.
Figure 5:
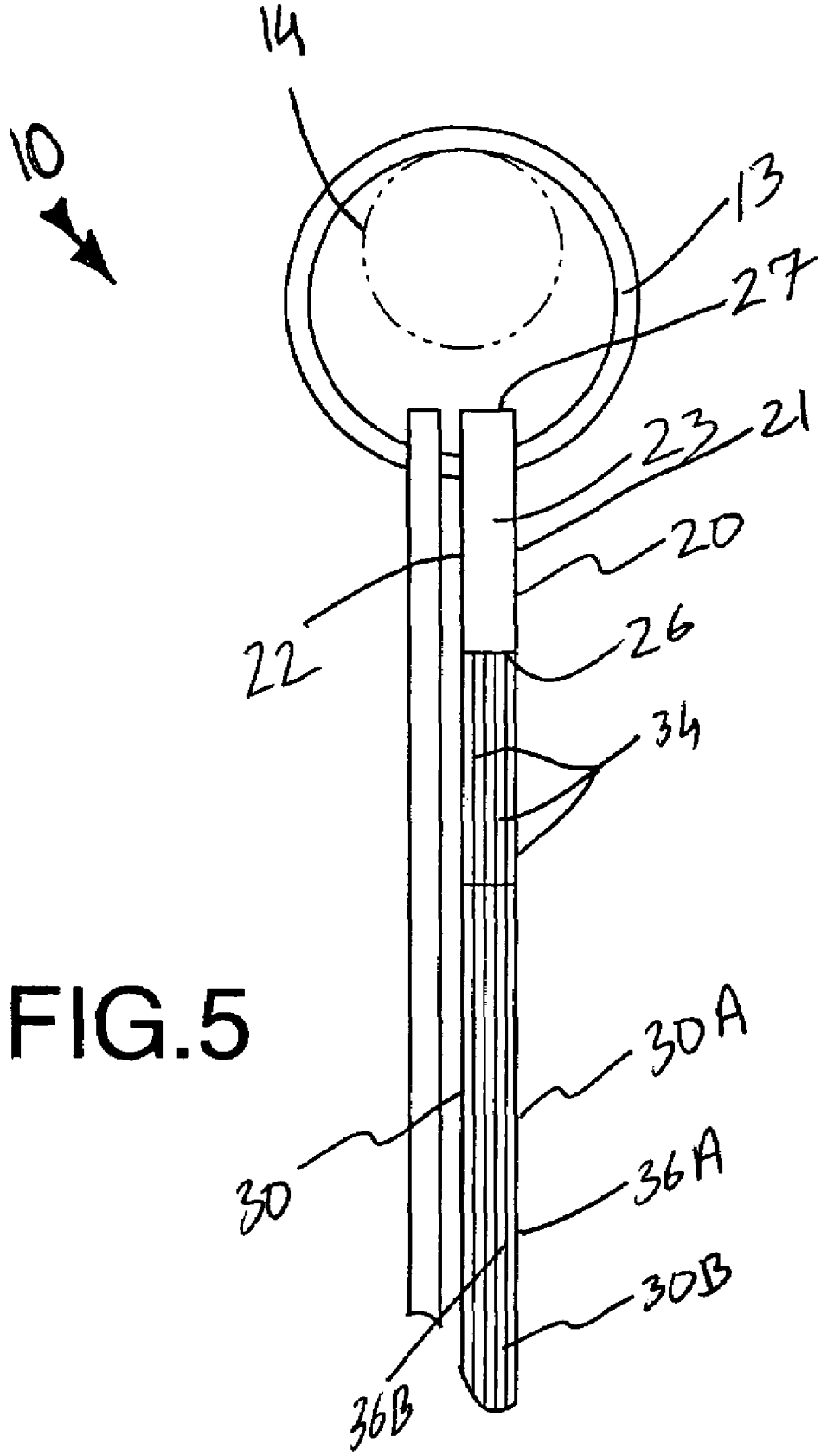
FIG. 5 is an enlarged side elevational view of section 5 shown in FIG. 2.

Still referring to FIGS. 1, 3, 4 and 5, such an anchor bracket 20 has a rectilinear and elongated shape provided with axially opposed ends 23 positioned at opposite ends of a shower wall 12. The anchor bracket 20 is provided with a plurality of apertures 24 formed therein that are equidistantly spaced along a longitudinal length of the anchor bracket 20. Each of the apertures 24 traverses a longitudinal axis of the anchor bracket 20 and is suitably sized for effectively receiving a support ring 13 therethrough, which is vital for allowing the assembly 10 to be suspended from a shower curtain rod 14, as is best shown in FIG. 5. The anchor bracket 20 further has a notch 25 medially formed therein that extends along the entire longitudinal length of the anchor bracket 20. Such a notch 25 has an open bottom end 26 that extends upwardly towards a top face 27 of the anchor bracket 20 wherein the notch 25 terminates subjacent the apertures 24 and has a U-shaped cross-section, as is illustrated in FIG. 4.

Referring to FIGS. 1 through 5, a plurality of disposable shower liners 30 have top edges 31 intercalated and nested within the notch 25 in such a manner that the shower liners 30 are effectively supported by the anchor bracket 20 respectively. Such shower liners 30 are formed from a disposable and water-impermeable material, which is crucial for allowing same to be repeatedly employed in the moist environment of a shower 11. Each of the shower liners 30 further has a bottom edge 32, a left side edge 33A and a right side edge 33B monolithically formed with the top edge 31 respectively. Such a bottom edge 32 of the outer shower liner 30A (described herein below) is partially detached from the bottom edge of the adjacent shower liner 30B (described herein below) during showering conditions such that the top edges 31 of the outer 30A and adjacent 30B shower liners remain directly affixed, without the use of intervening elements, during showering conditions.

Referring to FIGS. 1, 3 and 5, each shower liner 30 also has a tab 34 monolithically formed therewith. Each of the tabs 34 is positioned at a top corner 35 of an associated one of the shower liners 30 wherein the top corner 35 is defined at a juncture of the top edge 31 and the left side edge 33A of each shower liner 30. Such tabs 34 are critical and advantageous for providing a gripping surface whereby a user may grasp and remove the outer shower liner 30A without having to touch the mildew and possibly bacteria covered surface thereof. Adjacent front 36A and back 36B faces of the shower liners 30 are directly and continuously attached, without the use of intervening elements, which is important such that the shower liners 30 remain coplanar during non-showering conditions.

Referring to FIG. 1, a mechanism 40 is included for removably affixing the shower liners 30 together in such a manner that an entire perimeter of an outer one 30A of the shower liners 30 remains sealed directly, without the use of intervening elements, to an entire perimeter of an adjacent one 30B of the shower liners 30 during showering conditions. This is an essential feature for preventing moisture from becoming lodged between adjacent shower liners 30, and subsequently causing mold to grow in between the liners 30 prior to the outer liner 30A being removed. It is critical for maintaining the shower liners 30 securely attached by employing the present technique of securing the perimeter of the shower liners 30. The invention would not work equally as well if the shower liners 30 are not affixed in such a manner. Such an adjacent shower liner 30B is effectively and advantageously hidden by the outer shower 30A liner during showering conditions. The outer shower liner 30A is completely and effectively detachable from the anchor bracket 20 and the adjacent shower liner 30B when a user pulls an associated one of the tabs 34 downwardly and away from the anchor bracket 20. This feature advantageously eliminates the labor intensive and time consuming process of having to remove and wash conventional shower curtain liners. The adjacent shower liner 30B becomes exposed after the outer shower liner 30A is detached from the anchor bracket 20 such that the adjacent shower liner 30B directly faces the interior of the shower 11.

Still referring to FIG. 1, the removably affixing mechanism 40 includes a unitary and continuous adhesive layer 41 that includes a water-insoluble sealant running along a perimeter of a rear face 36B of each of the shower liners 30. Such an adhesive layer 41 is directly connected, without the use of intervening elements, to the rear face 36B of each of the shower liners 30 such that the adhesive layer 41 is effectively and advantageously isolated from water during showering procedures, thus preventing the adhesive layer 41 from becoming prematurely detached. The adhesive layer 41 is positioned along the top edge 31, the bottom edge 32, the left side edge 33A and the right side edge 33B of each of the shower liners 30 respectively. Such top edges 31 of the shower liners 30 are sandwiched between the front 21 and rear 22 faces of the anchor bracket 20 such that a portion of the adhesive layer 41 is interfitted within and along the notch 25 during anchored conditions.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A disposable shower curtain assembly for providing a plurality of disposable shower curtains hanging from a horizontally registered support rod, said disposable shower curtain assembly comprising:

an anchor bracket having a planar front face facing an interior of a shower and further having a planar rear face facing oppositely away from the shower, said anchor bracket further having a rectilinear and elongated shape provided with axially opposed ends positioned at opposite ends of a shower wall, said anchor bracket being provided with a plurality of apertures formed therein that are equidistantly spaced along a longitudinal length of said anchor bracket, each of said apertures traversing a longitudinal axis of said anchor bracket and being suitably sized for receiving a support ring therethrough, said anchor bracket further having a notch medially formed therein and extending along the entire longitudinal length of said anchor bracket, said notch having an open bottom end and extending upwardly towards a top face of said anchor bracket wherein said notch terminates subjacent said apertures and has a U-shaped cross-section;

a plurality of disposable shower liners having top edges intercalated and nested within said notch in such a manner that said shower liners are effectively supported by said anchor bracket respectively, each of said shower liners further having a bottom edge, a left side edge and a right side edge monolithically formed with said top edge respectively, each of said shower liners further having a tab monolithically formed therewith, each of said tabs being positioned at a top corner of an associated one of said shower liners wherein said top corner is defined at a juncture of said top edge and said left side edge of each said shower liners; and means for removably affixing said shower liners together in such a manner that an entire perimeter of an outer one of said shower liners remains sealed directly to an entire perimeter of an adjacent one of said shower liners during showering conditions, said adjacent shower liner being hidden by said outer shower liner during showering conditions, said outer shower liner being completely detachable from said anchor bracket and said adjacent shower liner when a user pulls an associated one of said tabs downwardly and away from said anchor bracket, wherein said adjacent shower liner becomes exposed after said outer shower liners is detached from said anchor bracket such that said adjacent shower liner directly faces the interior of said shower.

2. The assembly of claim 1, wherein said removably affixing means comprises:

a unitary and continuous adhesive layer including a water-insoluble sealant running along a perimeter of a rear face of each of said shower liners, said adhesive layer being directly connected to said rear face of each of said shower liners such that said adhesive layer is isolated from water during showering procedures.

3. The assembly of claim 2, wherein said adhesive layer is positioned along said top edge, said bottom edge, said left side edge and said right side edge of each of said shower liners respectively.

4. The assembly of claim 1, wherein said bottom edge of said outer shower liner is partially detached from said bottom edge of said adjacent shower liner during showering conditions such that said top edges of said outer and adjacent shower liners remain directly affixed during showering conditions.

5. The assembly of claim 2, wherein said top edges of said shower liners are sandwiched between said front and rear faces of said anchor bracket such that a portion of said adhesive layer is interfitted within and along said notch during anchored conditions.

6. The assembly of claim 1, wherein said anchor bracket is formed from rigid and non-corrosive material, said anchor bracket being formed from disposable material such that the user can discard said anchor bracket after a final one of said shower liners is detached therefrom.

7. A disposable shower curtain assembly for providing a plurality of disposable shower curtains hanging from a horizontally registered support rod, said disposable shower curtain assembly comprising:

an anchor bracket having a planar front face facing an interior of a shower and further having a planar rear face facing oppositely away from the shower, said anchor bracket further having a rectilinear and elongated shape provided with axially opposed ends positioned at opposite ends of a shower wall, said anchor bracket being provided with a plurality of apertures formed therein that are equidistantly spaced along a longitudinal length of said anchor bracket, each of said apertures traversing a longitudinal axis of said anchor bracket and being suitably sized for receiving a support ring therethrough, said anchor bracket further having a notch medially formed therein and extending along the entire longitudinal length of said anchor bracket, said notch having an open bottom end and extending upwardly towards a top face of said anchor bracket wherein said notch terminates subjacent said apertures and has a U-shaped cross-section;

a plurality of disposable shower liners having top edges intercalated and nested within said notch in such a manner that said shower liners are effectively supported by said anchor bracket respectively, each of said shower liners further having a bottom edge, a left side edge and a right side edge monolithically formed with said top edge respectively, each of said shower liners further having a tab monolithically formed therewith, each of said tabs being positioned at a top corner of an associated one of said shower liners wherein said top corner is defined at a juncture of said top edge and said left side edge of each said shower liners, wherein adjacent front and back faces of said shower liners are directly and continuously attached such that said shower liners remain coplanar during non-showering conditions; and means for removably affixing said shower liners together in such a manner that an entire perimeter of an outer one of said shower liners remains sealed directly to an entire perimeter of an adjacent one of said shower liners during showering conditions, said adjacent shower liner being hidden by said outer shower liner during showering conditions, said outer shower liner being completely detachable from said anchor bracket and said adjacent shower liner when a user pulls an associated one of said tabs downwardly and away from said anchor bracket, wherein said adjacent shower liner becomes exposed after said outer shower liners is detached from said anchor bracket such that said adjacent shower liner directly faces the interior of said shower.

8. The assembly of claim 7, wherein said removably affixing means comprises:

a unitary and continuous adhesive layer including a water-insoluble sealant running along a perimeter of a rear face of each of said shower liners, said adhesive layer being directly connected to said rear face of each of said shower liners such that said adhesive layer is isolated from water during showering procedures.

9. The assembly of claim 8, wherein said adhesive layer is positioned along said top edge, said bottom edge, said left side edge and said right side edge of each of said shower liners respectively.

10. The assembly of claim 7, wherein said bottom edge of said outer shower liner is partially detached from said bottom edge of said adjacent shower liner during showering conditions such that said top edges of said outer and adjacent shower liners remain directly affixed during showering conditions.

11. The assembly of claim 7, wherein said top edges of said shower liners are sandwiched between said front and rear faces of said anchor bracket such that a portion of said adhesive layer is interfitted within and along said notch during anchored conditions.

12. The assembly of claim 7, wherein said anchor bracket is formed from rigid and non-corrosive material, said anchor bracket being formed from disposable material such that the user can discard said anchor bracket after a final one of said shower liners is detached therefrom.

13. A disposable shower curtain assembly for providing a plurality of disposable shower curtains hanging from a horizontally registered support rod, said disposable shower curtain assembly comprising:

an anchor bracket having a planar front face facing an interior of a shower and further having a planar rear face facing oppositely away from the shower, said anchor bracket further having a rectilinear and elongated shape provided with axially opposed ends positioned at opposite ends of a shower wall, said anchor bracket being provided with a plurality of apertures formed therein that are equidistantly spaced along a longitudinal length of said anchor bracket, each of said apertures traversing a longitudinal axis of said anchor bracket and being suitably sized for receiving a support ring therethrough, said anchor bracket further having a notch medially formed therein and extending along the entire longitudinal length of said anchor bracket, said notch having an open bottom end and extending upwardly towards a top face of said anchor bracket wherein said notch terminates subjacent said apertures and has a U-shaped cross-section;

a plurality of disposable shower liners having top edges intercalated and nested within said notch in such a manner that said shower liners are effectively supported by said anchor bracket respectively, wherein said shower liners are formed from a disposable and water-impermeable material, each of said shower liners further having a bottom edge, a left side edge and a right side edge monolithically formed with said top edge respectively, each of said shower liners further having a tab monolithically formed therewith, each of said tabs being positioned at a top corner of an associated one of said shower liners wherein said top corner is defined at a juncture of said top edge and said left side edge of each said shower liners, wherein adjacent front and back faces of said shower liners are directly and continuously attached such that said shower liners remain coplanar during non-showering conditions; and means for removably affixing said shower liners together in such a manner that an entire perimeter of an outer one of said shower liners remains sealed directly to an entire perimeter of an adjacent one of said shower liners during showering conditions, said adjacent shower liner being hidden by said outer shower liner during showering conditions, said outer shower liner being completely detachable from said anchor bracket and said adjacent shower liner when a user pulls an associated one of said tabs downwardly and away from said anchor bracket, wherein said adjacent shower liner becomes exposed after said outer shower liners is detached from said anchor bracket such that said adjacent shower liner directly faces the interior of said shower.

14. The assembly of claim 13, wherein said removably affixing means comprises:

a unitary and continuous adhesive layer including a water-insoluble sealant running along a perimeter of a rear face of each of said shower liners, said adhesive layer being directly connected to said rear face of each of said shower liners such that said adhesive layer is isolated from water during showering procedures.

15. The assembly of claim 14, wherein said adhesive layer is positioned along said top edge, said bottom edge, said left side edge and said right side edge of each of said shower liners respectively.

16. The assembly of claim 13, wherein said bottom edge of said outer shower liner is partially detached from said bottom edge of said adjacent shower liner during showering conditions such that said top edges of said outer and adjacent shower liners remain directly affixed during showering conditions.

17. The assembly of claim 13, wherein said top edges of said shower liners are sandwiched between said front and rear faces of said anchor bracket such that a portion of said adhesive layer is interfitted within and along said notch during anchored conditions.

18. The assembly of claim 13, wherein said anchor bracket is formed from rigid and non-corrosive material, said anchor bracket being formed from disposable material such that the user can discard said anchor bracket after a final one of said shower liners is detached therefrom.

* * * * *